US007879161B2

(12) United States Patent
Goyal

(10) Patent No.: US 7,879,161 B2
(45) Date of Patent: Feb. 1, 2011

(54) STRONG, NON-MAGNETIC, CUBE TEXTURED ALLOY SUBSTRATES

(75) Inventor: Amit Goyal, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 673 days.

(21) Appl. No.: 11/835,725

(22) Filed: Aug. 8, 2007

(65) Prior Publication Data

US 2009/0038714 A1 Feb. 12, 2009

(51) Int. Cl.
*C22C 19/03* (2006.01)
*C22F 1/10* (2006.01)

(52) U.S. Cl. ..... 148/426; 148/677; 117/902

(58) Field of Classification Search ..... 148/676, 148/677, 409, 426; 117/902; 428/545, 680, 428/930; 505/239, 812–814
See application file for complete search history.

(56) References Cited

U.S. PATENT DOCUMENTS

| | | | |
|---|---|---|---|
| 5,739,086 | A | 4/1998 | Goyal et al. |
| 5,741,377 | A | 4/1998 | Goyal et al. |
| 5,846,912 | A | 12/1998 | Selvamanickam et al. |
| 5,898,020 | A | 4/1999 | Goyal et al. |
| 5,958,599 | A | 9/1999 | Goyal et al. |
| 5,964,966 | A | 10/1999 | Goyal et al. |
| 5,968,877 | A | 10/1999 | Budai et al. |
| 6,077,344 | A | 6/2000 | Shoup et al. |
| 6,106,615 | A | 8/2000 | Goyal et al. |
| 6,114,287 | A | 9/2000 | Lee et al. |
| 6,150,034 | A | 11/2000 | Paranthaman et al. |
| 6,156,376 | A | 12/2000 | Paranthaman et al. |
| 6,159,610 | A | 12/2000 | Paranthaman et al. |
| 6,180,570 | B1 | 1/2001 | Goyal |
| 6,235,402 | B1 | 5/2001 | Shoup et al. |
| 6,261,704 | B1 | 7/2001 | Paranthaman et al. |
| 6,270,908 | B1 | 8/2001 | Williams et al. |
| 6,331,199 | B1 | 12/2001 | Goyal et al. |
| 6,375,768 | B1 | 4/2002 | Goyal |
| 6,399,154 | B1 | 6/2002 | Williams et al. |
| 6,440,211 | B1 | 8/2002 | Beach et al. |
| 6,447,714 | B1 * | 9/2002 | Goyal et al. ..... 419/28 |
| 6,451,450 | B1 | 9/2002 | Goyal et al. |
| 6,468,591 | B1 | 10/2002 | Paranthaman et al. |
| 6,486,100 | B1 | 11/2002 | Lee et al. |

(Continued)

FOREIGN PATENT DOCUMENTS

EP 1208244 B1 5/2004

(Continued)

OTHER PUBLICATIONS

H. Sakamoto et al. Development of textured substrates with low magnetism, Physica C., vol. 436-465, (May 24, 2007), pp. 600-603.*

(Continued)

*Primary Examiner*—George Wyszomierski
*Assistant Examiner*—Mark L Shevin
(74) *Attorney, Agent, or Firm*—Novak Druce + Quigg LLP; Gregory A. Nelson

(57) ABSTRACT

A warm-rolled, annealed, polycrystalline, cube-textured, {100}<100>, FCC-based alloy substrate is characterized by a yield strength greater than 200 MPa and a biaxial texture characterized by a FWHM of less than 15° in all directions.

53 Claims, 15 Drawing Sheets

U.S. PATENT DOCUMENTS

| | | | |
|---|---|---|---|
| 6,599,346 | B2 | 7/2003 | Goyal et al. |
| 6,602,313 | B2 | 8/2003 | Goyal et al. |
| 6,607,838 | B2 | 8/2003 | Goyal et al. |
| 6,607,839 | B2 | 8/2003 | Goyal et al. |
| 6,610,413 | B2 | 8/2003 | Goyal et al. |
| 6,610,414 | B2 | 8/2003 | Goyal et al. |
| 6,635,097 | B2 | 10/2003 | Goyal et al. |
| 6,645,313 | B2 | 11/2003 | Goyal et al. |
| 6,663,976 | B2 | 12/2003 | Beach et al. |
| 6,670,308 | B2 | 12/2003 | Goyal |
| 6,716,795 | B2 | 4/2004 | Norton et al. |
| 6,740,421 | B1 | 5/2004 | Goyal |
| 6,764,770 | B2 | 7/2004 | Paranthaman et al. |
| 6,784,139 | B1 | 8/2004 | Sankar et al. |
| 6,790,253 | B2 | 9/2004 | Goyal et al. |
| 6,797,030 | B2 | 9/2004 | Goyal et al. |
| 6,846,344 | B2 | 1/2005 | Goyal et al. |
| 6,890,369 | B2 | 5/2005 | Goyal et al. |
| 6,902,600 | B2 | 6/2005 | Goyal et al. |
| 7,087,113 | B2 | 8/2006 | Goyal |

FOREIGN PATENT DOCUMENTS

| | | |
|---|---|---|
| WO | 00/60132 | 10/2000 |

OTHER PUBLICATIONS

A. Goyal, Chapter 2: Epitaxial Superconductors on Rolling-Assisted Biaxially-Textured-Substrate (RABiTS), in Second-Generation HTS Conductors, Kluwer Academic Published, Published 2005, pp. 29-36.*

Ijaduola, A.O., et al., "Magnetism and Ferromagnetic Loss in Ni-W Textured Substrates for Coated Conductors," Physica C, 2004, pp. 163-171, vol. 403.

Thompson, J.R., et al., Ni-Cr Textured Substrates with Reduced Ferromagnetism for Coated Conductor Applications, 2002, Physica C, pp. 169-176, vol. 370.

Subarmanya, Sarma et al., On the Cold Rolling Textures in Some fcc Ni-W Alloys, Materials Science and Engineering A, 2004, pp. 30-33, vol. 380A.

Schastlivtsev et al., "Nickel Alloy Substrates with a Sharp Cube Texture for High-Tc Superconducting Tapes," Doklady Physics, 2004, pp. 167-170, vol. 49.

F.J. Humphreys and M. Hatherly, "A(111) Pole Figure of the Pure Metal and Alloy-Type Texture is shown in Fig. 2.2.a and Fig. 2.2b," p. 44, "Recrystallization and related annealing phenomena", 1995.

Gallagher, P.C.J., "Figure17(b)," Met Trans. A1, 1970, p. 2429.

Richard M. Bozorth, "Ferromagnetism," 1951, D. Van Nostrand Company, pp. 8, 269-270, 307-308, 320-321, and 325-325, 8th edition.

F.J. Humphreys and M. Hatherly, "Recrystallization and Related Annealing Phenomena", 1995, pp. 328-329.

Charles Barrett and T.B. Massalski, "Structure of Metals,", 1980, p. 558.

* cited by examiner

Ni-3W-As roll

Ni-9W-Am

80% deformation

90% deformation

92% deformation

94% deformation

96% deformation

98% deformation

99% deformation 99.9% deformation

STRONG, NON-MAGNETIC, CUBE TEXTURED ALLOY SUBSTRATES

STATEMENT REGARDING FEDERALLY SPONSORED RESEARCH

The United States Government has rights in this invention pursuant to contract no. DE-AC05-00OR22725 between the United States Department of Energy and UT-Battelle, LLC.

CROSS-REFERENCE TO RELATED APPLICATIONS

Specifically referenced are the following U.S. patents, the entire disclosures of which are incorporated herein by reference:

U.S. Pat. No. 5,741,377 issued on Apr. 21, 1998 to Amit Goyal, et al. entitled "Structures Having Enhanced Biaxial Texture and Method of Fabricating Same".

U.S. Pat. No. 5,741,377 issued on Apr. 21, 1998 to Amit Goyal, et al. entitled "Structures Having Enhanced Biaxial Texture and Method of Fabricating Same".

U.S. Pat. No. 5,739,086 issued on Apr. 14, 1998 to Amit Goyal, et al. entitled "Structures Having Enhanced Biaxial Texture and Method of Fabricating Same".

U.S. Pat. No. 5,898,020 issued on Apr. 27, 1999 to Amit Goyal, et al. entitled "Structures Having Enhanced Biaxial Texture and Method of Fabricating Same".

U.S. Pat. No. 5,968,877 issued on Oct. 19, 1999 to Budai, et al. entitled "High Tc YBCO Superconductor Deposited on Biaxially Textured Ni Substrate".

U.S. Pat. No. 6,261,704 issued on Jul. 17, 2001 to Paranthaman, et al. entitled "MgO Buffer Layers on Rolled Nickel or Copper as Superconductor Substrates".

U.S. Pat. No. 6,468,591 issued on Oct. 22, 2002 to Paranthaman, et al. entitled "Method for Making MgO Buffer Layers on Rolled Nickel or Copper as Superconductor Substrates".

U.S. Pat. No. 6,077,344 issued Jun. 20, 2000 to Shoup, et al. entitled "Sol-Gel Deposition of Buffer Layers on Biaxially Textured Metal Substances".

U.S. Pat. No. 6,235,402 issued May 22, 2001 to Shoup, et al. entitled "Buffer Layers on Biaxially Textured Metal Substrates".

U.S. Pat. No. 6,180,570 issued Jan. 30, 2001 to Amit Goyal entitled "Biaxially Textured Articles Formed by Plastic Deformation".

U.S. Pat. No. 6,375,768 issued Apr. 23, 2002 to Amit Goyal entitled "Method for Making Biaxially Textured Articles by Plastic Deformation".

U.S. Pat. No. 5,964,966 issued Oct. 12, 1999 to Goyal, et al. entitled "Method of Forming Biaxially Textured Alloy Substrates and Devices Thereon".

U.S. Pat. No. 6,106,615 issued Aug. 22, 2000 to Goyal, et al. entitled "Method of Forming Biaxially Textured Alloy Substrates and Devices Thereon".

U.S. Pat. No. 6,784,139 issued Aug. 31, 2004 to Sankar, et al. entitled "Conductive and Robust Nitride Buffer Layers on Biaxially Textured Substrates".

U.S. Pat. No. 6,150,034 issued Nov. 21, 2000 to Paranthaman, et al. entitled "Buffer Layers on Rolled Nickel or Copper as Superconductor Substrates".

U.S. Pat. No. 6,159,610 issued Dec. 12, 2000 to Paranthaman, et al. entitled "Buffer Layers on Metal Surfaces Having Biaxial Texture as Superconductor Substrates".

U.S. Pat. No. 6,156,376 issued Dec. 5, 2000 to Paranthaman, et al. entitled "Buffer Layers on Metal Surfaces Having Biaxial Texture as Superconductor Substrates".

U.S. Pat. No. 6,440,211 issued Aug. 27, 2002 to Beach, et al. entitled "Method of Depositing Buffer Layers on Biaxially Textured Metal Substrates".

U.S. Pat. No. 6,663,976 issued Dec. 16, 2003 to Beach, et al. entitled "Laminate Articles on Biaxially Textured Metal Substrates".

U.S. Pat. No. 6,716,795 issued Apr. 6, 2004 to Norton, et al. entitled "Buffer Architecture for Biaxially Textured Structures and Method of Fabricating Same".

U.S. Pat. No. 6,270,908 issued Aug. 7, 2001 to Williams, et al. entitled "Rare Earth Zirconium Oxide Buffer Layers on Metal Substrates".

U.S. Pat. No. 6,399,154 issued Jun. 4, 2002 to Williams, et al. entitled "Laminate Article".

U.S. Pat. No. 6,451,450 issued Sep. 17, 2002 to Goyal, et al. entitled "Method of Depositing a Protective Layer Over a Biaxially Textured Alloy Substrate and Composition Therefrom".

U.S. Pat. No. 6,670,308 issued Dec. 30, 2003 to Amit Goyal entitled "Method of Depositing Epitaxial Layers on a Substrate".

U.S. Pat. No. 7,087,113 issued Aug. 8, 2006 to Amit Goyal entitled "Textured Substrate Tape and Devices Thereof".

U.S. Pat. No. 6,764,770 issued Jul. 20, 2004 to Paranthaman, et al. entitled "Buffer Layers and Articles for Electronic Devices".

U.S. Pat. No. 5,846,912 issued Dec. 8, 1998 to Selvamanickam, et al. entitled "Method for Preparation of Textured $YBa_2Cu_3O_x$ Superconductor".

U.S. Pat. No. 5,958,599 issued Sep. 28, 1999 to Goyal, et al. entitled "Structures Having Enhanced Biaxial Texture".

U.S. Pat. No. 6,114,287 issued Sep. 5, 2000 to Lee, et al. entitled "Method of Deforming a Biaxially Textured Buffer Layer on a Textured Metallic Substrate and Articles Therefrom".

U.S. Pat. No. 6,331,199 issued Dec. 18, 2001 to Goyal, et al. entitled "Biaxially Textured Articles Formed by Powder Metallurgy".

U.S. Pat. No. 6,447,714 issued Sep. 10, 2002 to Goyal, et al. entitled "Method for Forming Biaxially Textured Articles by Powder Metallurgy".

U.S. Pat. No. 6,486,100 issued Nov. 26, 2002 to Lee, et al. entitled "Method for Preparing Preferentially Oriented High Temperature Superconductors Using Solution Reagents".

U.S. Pat. No. 6,599,346 issued Jul. 29, 2003 to Goyal, et al. entitled "Biaxially Textured Articles Formed by Powder Metallurgy".

U.S. Pat. No. 6,602,313 issued Aug. 5, 2003 to Goyal, et al. entitled "Biaxially Textured Articles Formed by Powder Metallurgy".

U.S. Pat. No. 6,607,838 issued Aug. 19, 2003 to Goyal, et al. entitled "Biaxially Textured Articles Formed by Powder Metallurgy".

U.S. Pat. No. 6,607,839 issued Aug. 19, 2003 to Goyal, et al. entitled "Biaxially Textured Articles Formed by Powder Metallurgy".

U.S. Pat. No. 6,610,413 issued Aug. 26, 2003 to Goyal, et al. entitled "Biaxially Textured Articles Formed by Powder Metallurgy".

U.S. Pat. No. 6,610,414 issued Aug. 26, 2003 to Goyal, et al. entitled "Biaxially Textured Articles Formed by Powder Metallurgy".

U.S. Pat. No. 6,635,097 issued Oct. 21, 2003 to Goyal, et al. entitled "Biaxially Textured Articles Formed by Powder Metallurgy".

U.S. Pat. No. 6,645,313 issued Nov. 11, 2003 to Goyal, et al. entitled "Powder-in-Tube and Thick-Film Methods of Fabricating High Temperature Superconductors Having enhanced Biaxial Texture".

U.S. Pat. No. 6,740,421 issued May 25, 2004 to Amit Goyal entitled "Rolling Process for Producing Biaxially Textured Substrates".

U.S. Pat. No. 6,790,253 issued Sep. 14, 2004 to Goyal, et al. "entitled Biaxially Textured Articles Formed by Powder Metallurgy".

U.S. Pat. No. 6,797,030 issued Sep. 28, 2004 to Goyal, et al. entitled "Biaxially Textured Articles Formed by Powder Metallurgy".

U.S. Pat. No. 6,846,344 issued Jan. 25, 2005 to Goyal, et al. entitled "Biaxially Textured Articles Formed by Powder Metallurgy".

U.S. Pat. No. 6,890,369 issued May 10, 2005 to Goyal, et al. entitled "Biaxially Textured Articles Formed by Powder Metallurgy".

U.S. Pat. No. 6,902,600 issued Jun. 7, 2005 to Goyal, et al. entitled "Biaxially Textured Articles Formed by Powder Metallurgy".

BACKGROUND OF THE INVENTION

Many applications of high temperature superconductors (HTSC) require the conductor to either withstand high mechanical stresses and/or strains during conductor fabrication or during use in application. Moreover, for many applications, a essentially non-magnetic substrate is desired at the temperature of application to eliminate or minimize AC losses from the substrate. For superconductor applications, a biaxially texture (i.e., cube texture) is also desirable. Biaxial texture, for the purposes of describing the present invention, is defined as follows:

The unit cells of all materials can be characterized by three co-ordinate axes: a, b, and c. The orientation of an individual grain in a polycrystalline specimen can be defined by the angles made by it's a, b, and c crystallographic axes with the reference specimen co-ordinate system. "Uniaxial texture" refers to alignment of any one of these axes in essentially all the grains comprising the polycrystalline specimen. The "degree of uniaxial texture" can be determined using electron backscatter diffraction or by X-ray diffraction. Typically, it is found that the grains have a normal or a Gaussian distribution of orientations with a characteristic bell curve. The full-width-half-maximum (FWHM) of this Gaussian distribution or peak, is the "degree of uniaxial texture" and defines the "sharpness of the texture". Biaxial texture refers to a case wherein two of the three crystallographic axes of essentially all the grains are aligned within a certain degree or sharpness. For example, a biaxial texture characterized by a FWHM of 10°, implies that the independent distribution of orientations of two of the three crystallographic axes of essentially all the grains comprising the material can be described by a distribution wherein the FWHM is 10°. In cases wherein the material is characterized as cubic, the crystallographic axes a, b, and c are essentially perpendicular to one another. Biaxial texture of a certain degree essentially implies that all three crystallographic axes are aligned within a certain degree.

Currently, the preferred HTSC substrate material is a cube-textured Ni-5 at % W substrate having a yield strength of ~150-175 MPa. This substrate is quite suitable for growing high quality epitaxial buffer layers thereon. The substrate is textured by successive cold-rolling to deformations greater than 95% via rolling followed by recrystallization annealing to form a sharp biaxial texture in the material of interest. Ni-5 at % W is however magnetic at 77K, resulting in deleteriously high AC losses (see for example, A. O. Ijaduola, J. R. Thompson, A. Goyal, C. L. H. Thieme and K. Marken, "Magnetism and ferromagnetic loss in Ni—W textured substrates for coated conductors," Physica C 403 (2004) 163-171).

Moreover, cube-textured Ni—Cr substrates, including the non-magnetic Ni-13 at % Cr and Ni—Cr—W alloys, are non-magnetic and can be biaxially textured (see for example, J. R. Thompson, A. Goyal, D. K. Christen, D. M. Kroeger, Ni—Cr textured substrates with reduced ferromagnetism for coated conductor applications," Physica C 370 (2002) 169-176). However, deposition of buffer layers is not straightforward as non-epitaxial Cr oxides form very easily during deposition of the seed layer and result in partial (111) seed layer orientations, resulting in misorientations in the superconducting layer. Also, the mechanical properties of NI—Cr and Ni—Cr—W alloys are weak with the yield strength only being about 150 MPa.

It is reported that Ni-9.0 at % W is an essentially non-magnetic alloy for all temperatures above 25K, having a saturation magnetism of less than 4.36 G-cm$^3$/g (see for example Table 1 in A. O. Ijaduola, J. R. Thompson, A. Goyal, C. L. H. Thieme and K. Marken, "Magnetism and ferromagnetic loss in Ni—W textured substrates for coated conductors," Physica C 403 (2004) 163-171). In comparison, as reported in this paper, the Curie temperature of Ni-5 at % W is 339K, that of Ni-6 at % W is 250K and that of Ni-9 at % W is 25K. Alloys containing Ni-9 at % W are very strong, having a yield strength of about 270 MPa, and are chemically quite suitable for growing high quality epitaxial buffer layers thereon. However, it is known that Ni substrates containing greater than 5 at. % W made by successive rolling at room temperature and subsequent recrystallization annealing undergo a deleterious texture transition that results in poor biaxial texture, making the substrates unsuitable for superconductor applications (see for example, V. Subramanya Sarma, J. Eickemeyer, C. Mickel, L. Schultz, B. Holzapfel, "On the cold rolling textures in some fcc Ni—W alloys," Materials Science and Engineering A 380 (2004) 30-33).

The deformation texture of face-centered cubic (FCC) metals and alloys such as copper and nickel and their alloys can be of two types, either a "copper-type" texture (also called "pure metal-type" texture and denoted (123)[121]) or an "alloy-type" texture (also sometimes called "brass-deformation-type" texture and denoted (110)[112]). It is well known that the different deformation textures provide different recrystallization textures upon annealing. For example, the copper-type deformation texture is known to result (with appropriate annealing conditions) in a cube recrystallization texture, and the alloy-type deformation texture is known to result in a brass-type recrystallization texture. The cube texture is one of the preferred textures suggested in U.S. Pat. No. 5,741,377 referenced hereinabove.

As one or more solute or alloying elements A (such as Mo, W, Cr, V, Cu, Fe, Al . . . ) are added into copper or nickel ($Ni_{1-x}A_x$), and as the solute concentration x increases, it becomes increasingly difficult to achieve the copper-type rolling texture and then to obtain a cube or {100}<100>, recrystallization texture. In the range of a certain solute concentration, a gradual transition occurs with a mixture of textures, and above this concentration, one obtains primarily an alloy-type deformation texture which leads upon annealing to final brass recrystallization texture. The value of the transition solute concentration depends on the alloying element. Nickel and its low concentration alloys have high γ and give copper-type deformation texture, while as alloy concentration increases, γ steadily decreases, and above the transition solute concentration, a gradual texture transition with a mixed texture occurs and alloy-type deformation texture is increasingly obtained. The rate of decrease of γ with solute concentration x, and hence the value of the transition concentration, depends on the particular alloying element (see for example, "Recrystallization and Related annealing Phenomena" by F. J. Humphreys and M. Hatherly, 1995, pp. 328-329; "Structure of Metals" by Charles Barrett and T. B. Massalski, 1980, p. 558).

In the book titled "Recrystallization and Related annealing Phenomena" by F. J. Humphreys and M. Hatherly published in 1995 it is mentioned that for FCC metals and alloys which have a stacking fault energy, γ less than 25 $mJm^{-2}$, an "alloy-type" deformation texture is obtained when rolling at room temperature. The "alloy-type" texture is also commonly referred to as the "brass-type" texture. For metals and alloys which have a stacking fault energy, γ greater than this value such as Cu with a γ less than 80 $mJm^{-2}$ or Al with a γ of 170 $mJm^{-2}$, a "pure metal-type" deformation texture is obtained. This pure-metal-type texture is also commonly referred to as the copper-type or Cu-type texture. A (111) pole figure of the pure metal and alloy-type texture is shown in FIG. 2.2a and FIG. 2.2b on page 44 of F. J. Humphreys and M. Hatherly. The stacking fault energy, γ of pure Ni is in between that of pure Cu and Al. By addition of alloying elements to pure metals such as pure Copper and Nickel, the stacking fault energy decreases. When the stacking fault energy decreases below a certain point, a texture transition in the deformation texture occurs from a pure metal-type to an alloy-type texture. The systematic and monotonic variation of stacking fault energy of Ni with addition of W, Mo, Cr and V, and many other solutes has been reported (see for example FIG. 17(b) of P. C. J. Gallagher, Met. Trans. Al (1970) 2429). The observation by Sarma et al. (V. Subramanya Sarma, J. Eickemeyer, C. Mickel, L. Schultz, B. Holzapfel, "On the cold rolling textures in some FCC Ni—W alloys," Materials Science and Engineering A 380 (2004) 30-33) that above 5 at % W in binary NiW alloys, a mixed recrystallization texture is obtained upon heavy cold-rolling and annealing is consistent with the observations of Gallagher and Humphreys and Hatherly. The abstract of Sarma et al. states that the copper-type to brass-type texture transition in the rolling texture of cold rolled FCC $Ni_{1-x}W_x$ alloys occurs at W contents >5 at. %. FIG. 5 of this paper confirms this statement and shows that above 5 at % W only a mixed texture or a partial "cube texture" is obtained. This implies that by successive cold rolling of NiW alloys above 5 at % W to deformations greater than 95% followed by recrystallization annealing will not result in a single orientation, cube texture. Only mixed textures are obtained using the conventional cold rolling followed by the recrystallization annealing procedure. Such mixed textures are of little value for any application where grain boundary misorientations are important. For example, depositing epitaxial buffer layers followed by epitaxial deposition of a superconductor layer will result in a mixed texture in the superconductor layer. The mixed texture necessarily implies numerous high-angle gain boundaries which suppress super-current flow. A superconductor with such high-angle grain boundaries will result in poor performance and of little use in applications. For obtaining good superconducting properties, at least a cube texture greater than 90% and preferably greater than 95% is required.

Schastlivetsev et al, Doklady Physics 49 p 167 (2004), teaches that binary alloys of Ni with Al, V, W, Cr and Mo all have a certain compositional range wherein only the Cu-type or pure metal type deformation texture is produced. It is suggested that one can also use the lattice parameter of the alloy to determine where the texture transition will occur. It is further suggested that, while texture development is a function of the specific rolling parameters and/or the starting grain size, alloys with lattice parameters greater than mid point of the mixed range, i.e. greater than 3.55 Angstroms, will have a mixed texture.

The problem heretofore unsolved is how to obtain a sharp cube texture in certain FCC alloys based on Cu and Ni which, upon cold rolling, exhibit a texture transition and result in some alloy-type or brass-type rolling texture components. Such alloys upon subsequent recrystallization annealing give a mixed annealing texture comprising of some brass-annealing components. It is important to note that alloys with high solute contents, such as Ni-9 at % W for example, are those which have desirable properties such as reduced magnetism and significantly increased strength. Magnetism of Ni alloys as a function of alloying additions has been extensively discussed. See Richard M. Bozorth, "Ferromagnetism" $8^{th}$ edition, D. Van Nostrand Company, Princeton, N.J., 1951, pages 8, 269-270, 307-308, 320-321 and 325-326.

BRIEF SUMMARY OF THE INVENTION

In accordance with one aspect of the present invention, the foregoing and other objects are achieved by a warm-rolled and annealed, polycrystalline substrate for supporting an epitaxial functional layer that includes a Ni-based alloy having W in an amount in the range of 5 to 10 atomic %, the alloy characterized by a yield strength of at least 200 MPa and a biaxial texture characterized by a FWHM of less than 15° in all directions.

In accordance with another aspect of the present invention, a method of making a biaxially textured Ni—W substrate is provided, which includes the steps of: providing a body of a Ni-based alloy that includes W in an amount in the range of 5 to 10 atomic %; deforming the body by rolling at a temperature of at least 50° C. and less than the primary recrystallization temperature of the alloy; and annealing the deformed body to form a substrate characterized by a yield strength of at least 200 MPa and a biaxial texture characterized by a FWHM of less than 15° in all directions.

In accordance with a further aspect of the present invention, a substrate is provided, which includes a warm-rolled, annealed, polycrystalline, cube-textured, {100}<100>, FCC-based alloy characterized by a yield strength greater than 200 MPa and a biaxial texture characterized by a FWHM of less than 15° in all directions.

In accordance with yet another aspect of the present invention, a method of making a biaxially textured FCC-based alloy substrate is provided, which includes the steps of: providing a body of a FCC-based alloy that has a yield strength of greater than 200 MPa deforming the body by rolling at a temperature of at least 50° C. and less than the primary recrystallization temperature of the alloy to form a copper-type rolling texture; and recrystallizing the deformed body by thermal annealing to form a cube texture corresponding to {100}<100> and characterized by a FWHM of the biaxial texture of less than 15° in all directions.

For a better understanding of the present invention, together with other and further objects, advantages and capabilities thereof, reference is made to the following disclosure and appended claims in connection with the above-described drawings.

DETAILED DESCRIPTION OF THE INVENTION

Figure 1:
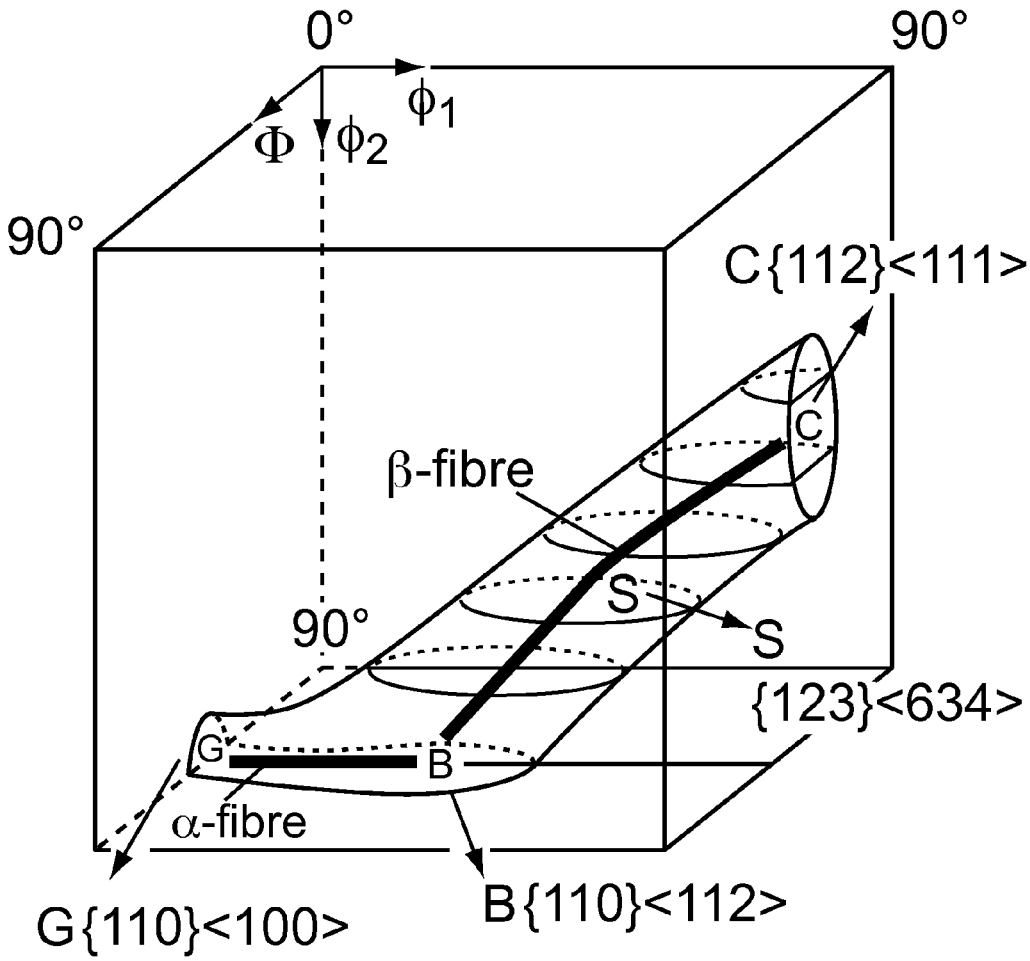
FIG. 1 is an idealized schematic representation of Euler Space showing the various fibers along which the texture in FCC metals and alloys lie upon rolling.

FIG. 1 shows typical fibers in Euler Space wherein orientation of grains of heavily deformed FCC materials tend to segregate to upon heavy deformation. For materials which form a sharp cube (biaxial) texture, all the intensity is found to segregate to only the beta fiber, with no intensity in the alpha fiber. This is generally referred to as the Cu-type rolling texture. See for example, pg. 46 of Humphreys and Hatherly, referenced hereinabove.

Figure 2A:
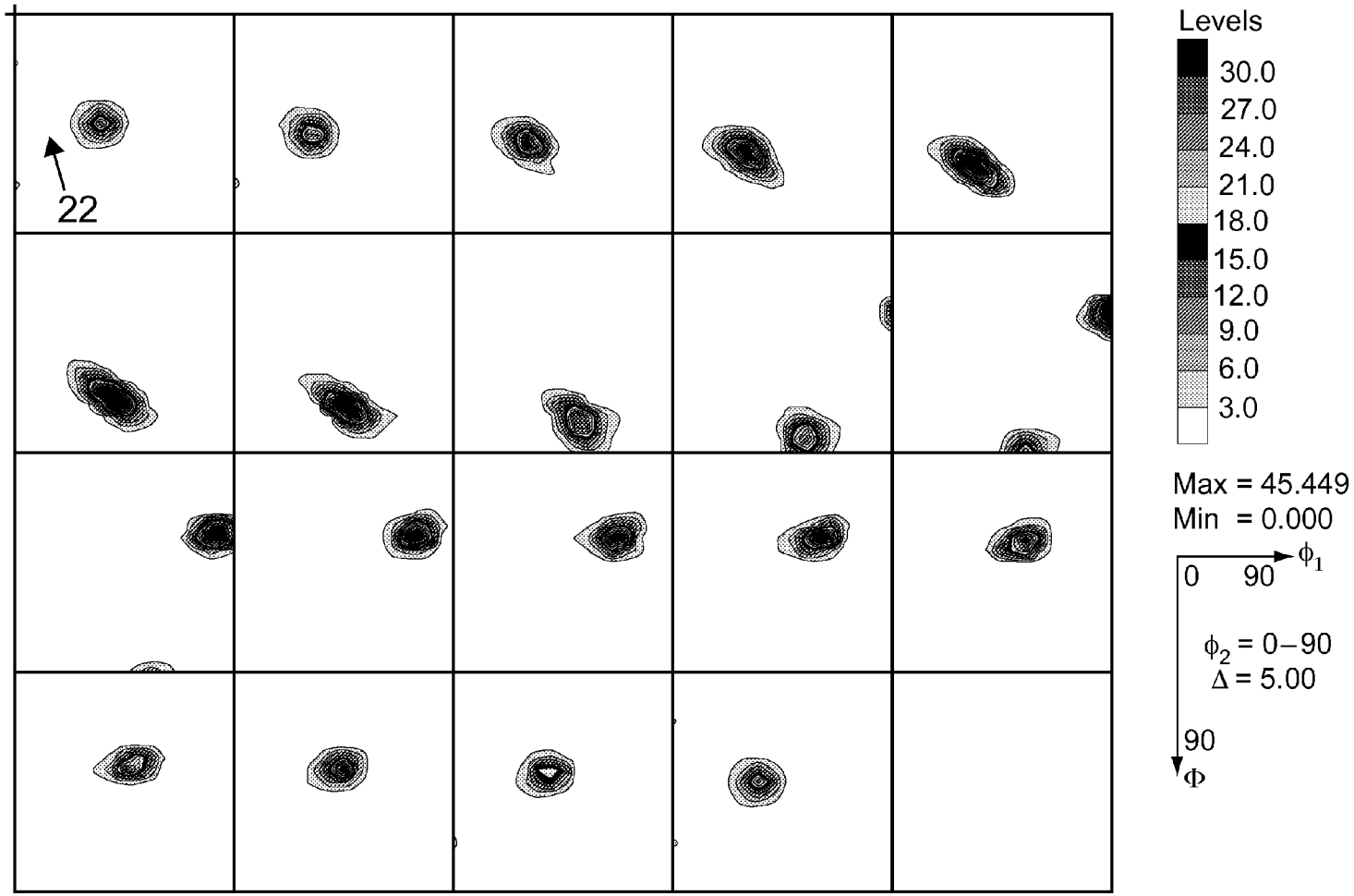
FIG. 2*a* is a series of diagrams showing slices of the orientation distribution functions (ODF) for a 99.9% deformed Ni-3 at % W alloy rolled at ambient (room) temperature. A Cu-type rolling texture has been maintained, as indicated by the absence of an α-fiber, shown by arrow 22.
Figure 2B:
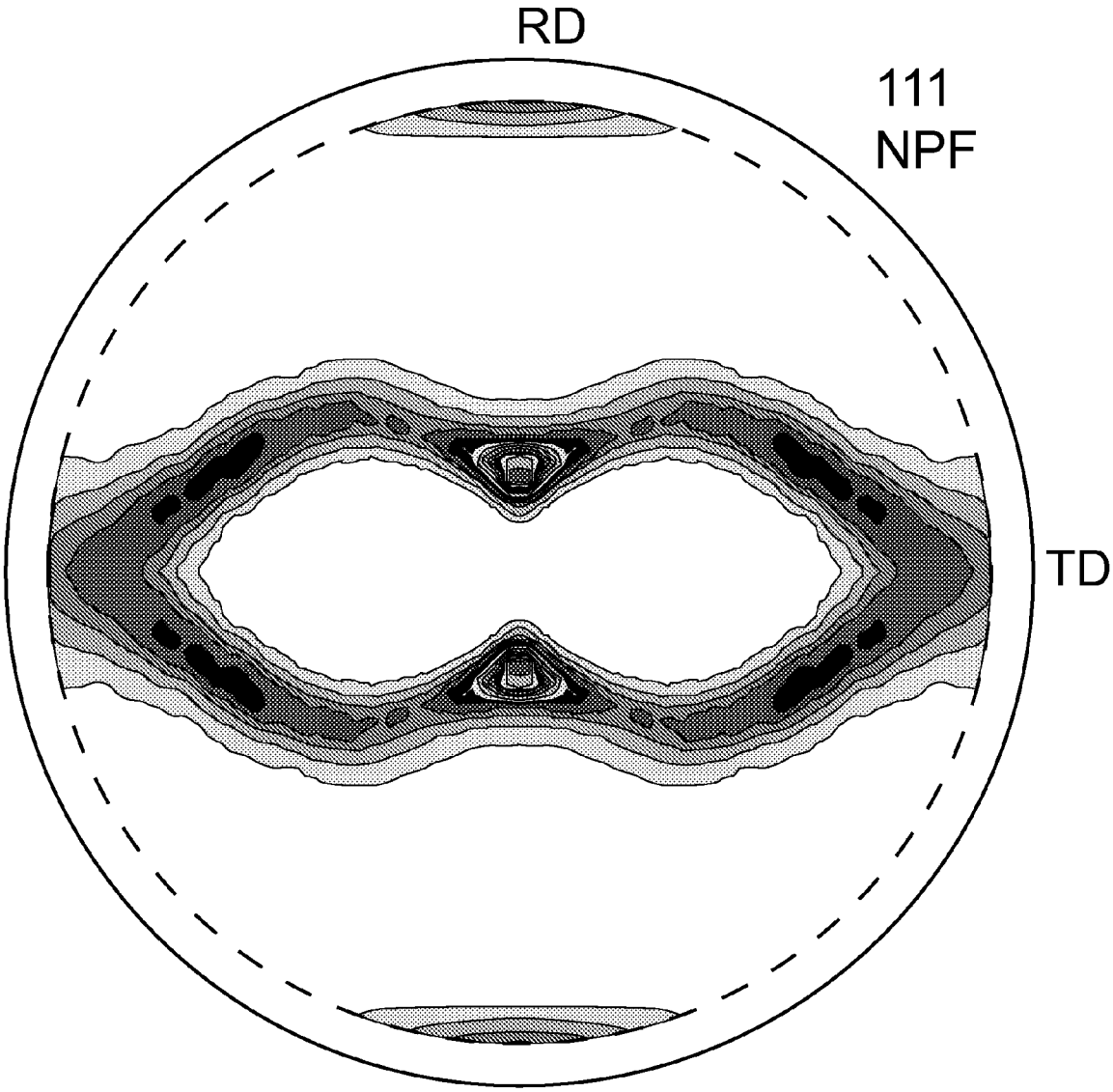
FIG. 2*b* is a (111) pole figure for a 99.9% deformed Ni-3 at % W alloy rolled at ambient temperature.
Figure 3A:
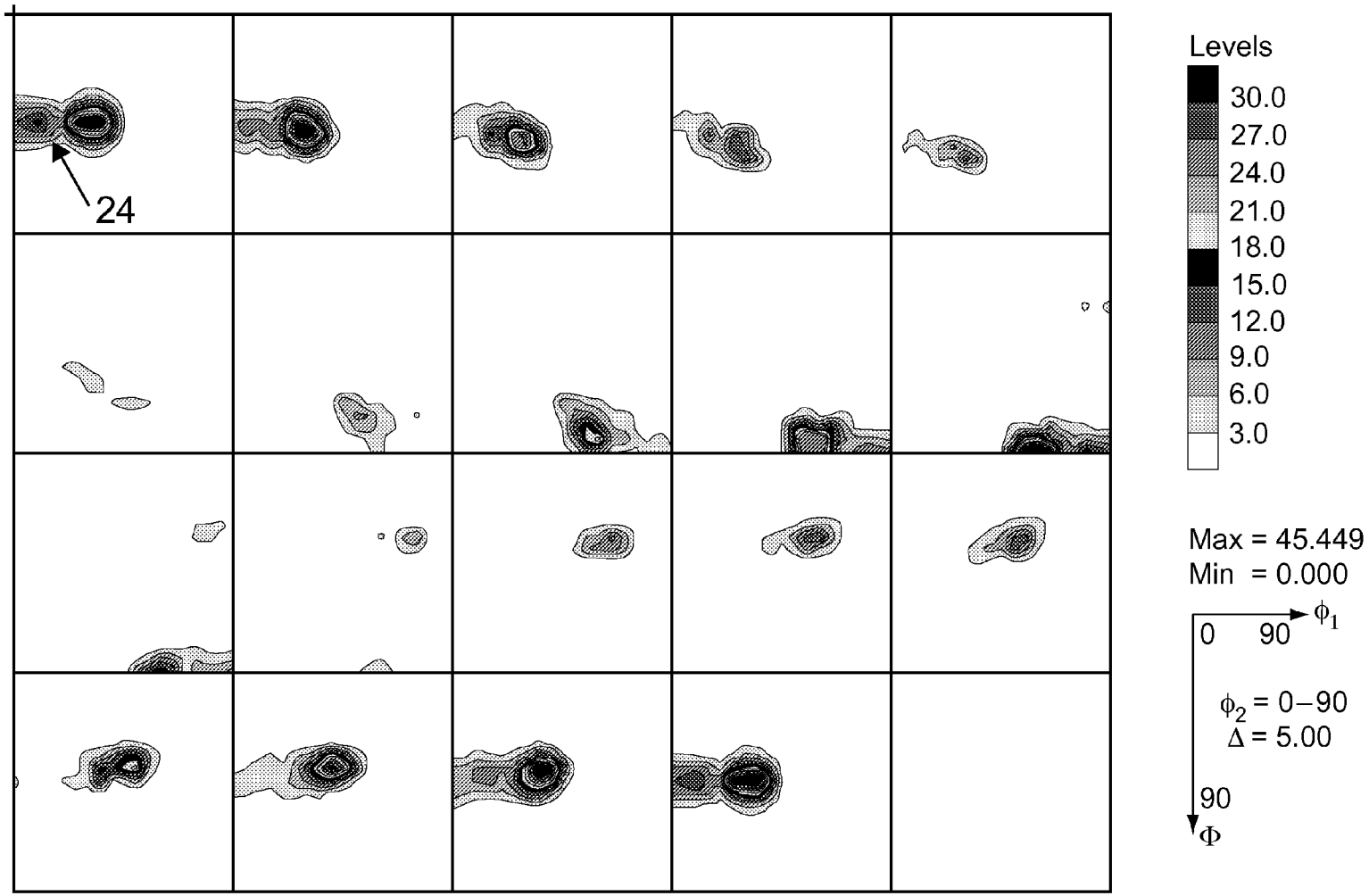
FIG. 3*a* is a series of diagrams showing slices of the ODF for a 99.9% deformed Ni-6.5 at % W alloy rolled at ambient temperature. The rolling texture has undergone a transition to the alloy-type or brass-type rolling texture as indicated by the presence of an α-fiber, shown by arrow 24.
Figure 3B:
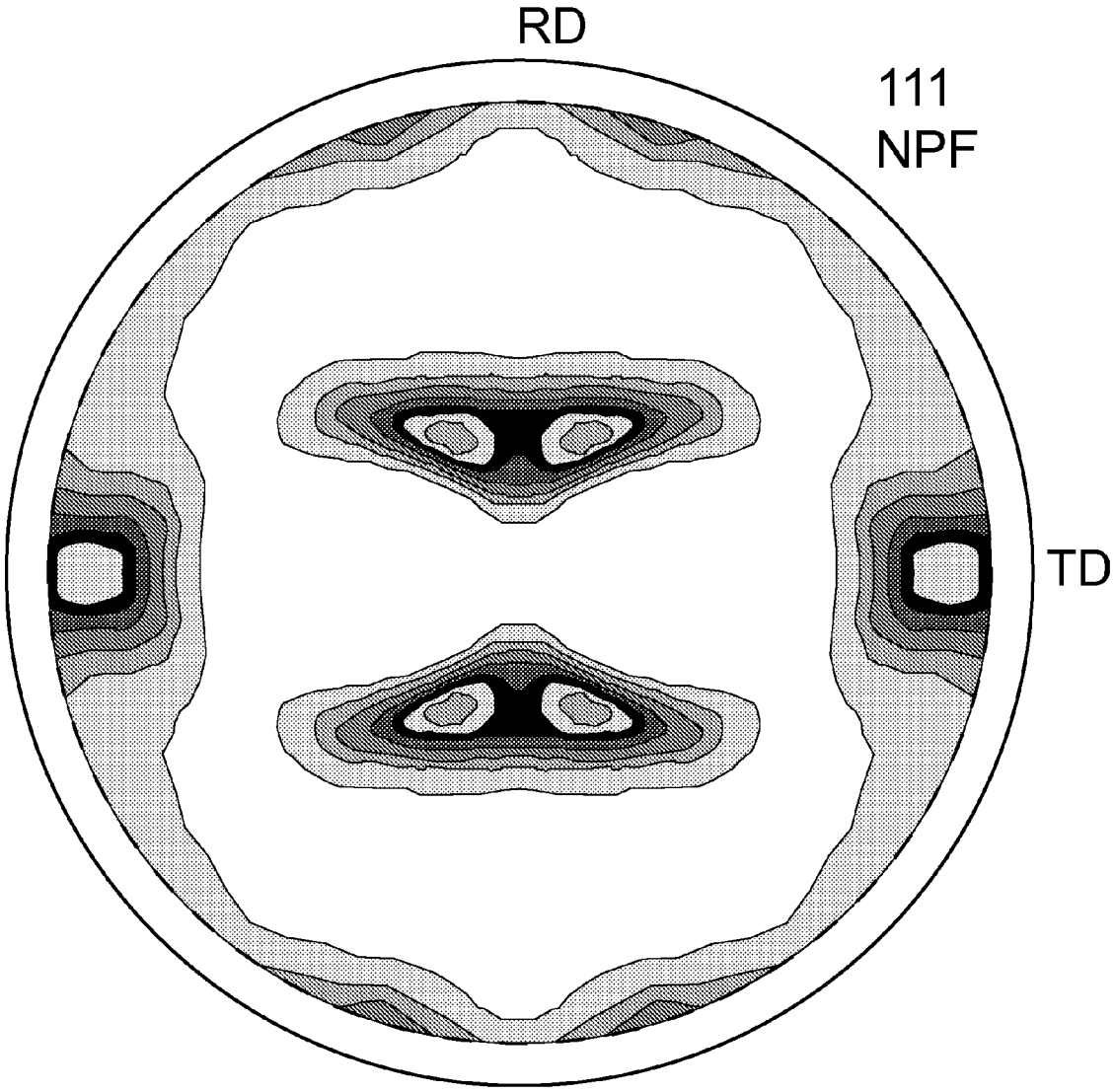
FIG. 3*b* is a (111) pole figure for a 99.9% deformed Ni-6.5 at % W alloy rolled at ambient temperature. The rolling texture has undergone a transition to the alloy-type or brass-type rolling texture.

FIG. 2*a* shows two-dimensional slices of the Euler Space diagram at various angles $\phi_2$. Such a representation is referred to as the orientation distribution function (ODF). FIG. 2*b* shows a (111) Ni—W pole figure for a 99.9% deformed Ni-3 at % W alloy. No alpha fiber is observed (see arrow 22) and all the intensity is in the beta fiber as confirmed by the ODF and the (111) NiW pole figure. However, upon increasing the W concentration of the alloy to, for example, 6.5 at % W, the alpha fiber is present as shown in the corresponding ODF in FIG. 3*a* (see arrow 24) and the (111) pole figure changes dramatically as shown in FIG. 3*b*. Cu-type rolling texture is no longer formed, but instead an undesirable "alloy type" rolling texture forms as shown in FIGS. 3*a* and 3*b*. Upon recrystallization, cube texture does not form.

Figure 4A:
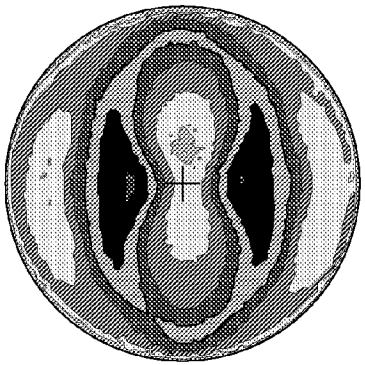
FIG. 4*a* is a (111) pole figure for an 80% deformed Ni-9.3 at % W alloy rolled at ambient temperature.
Figure 4B:
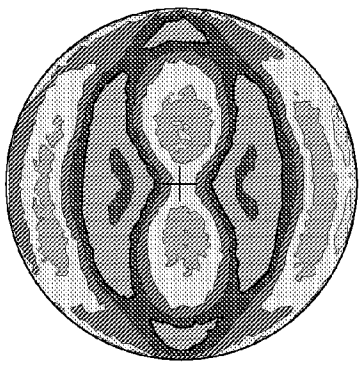
FIG. 4*b* is a (111) pole figure for a 90% deformed Ni-9.3 at % W alloy rolled at ambient temperature.
Figure 4C:
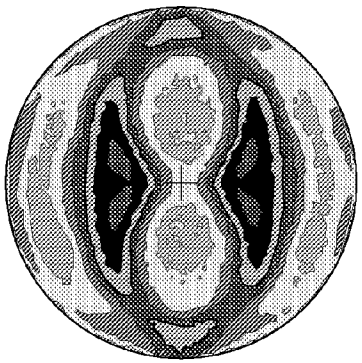
FIG. 4*c* is a (111) pole figure for a 92% deformed Ni-9.3 at % W alloy rolled at ambient temperature.
Figure 4D:
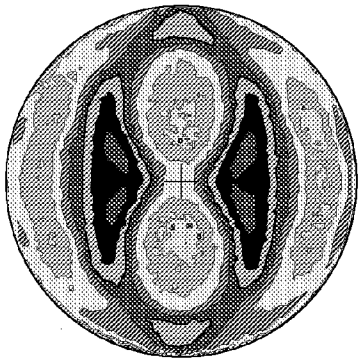
FIG. 4*d* is a (111) pole figure for a 94% deformed Ni-9.3 at % W alloy rolled at ambient temperature.
Figure 4E:
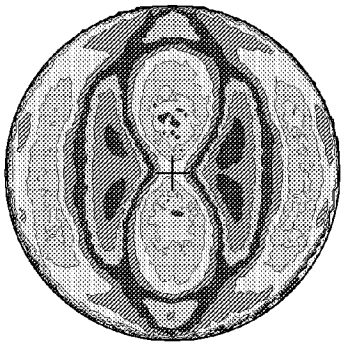
FIG. 4*e* is a (111) pole figure for a 96% deformed Ni-9.3 at % W alloy rolled at ambient temperature.
Figure 4F:
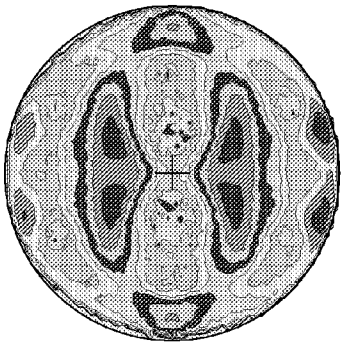
FIG. 4*f* is a (111) pole figure for a 98% deformed Ni-9.3 at % W alloy rolled at ambient temperature.
Figure 4G:
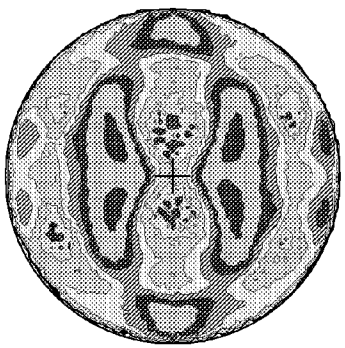
FIG. 4*g* is a (111) pole figure for a 99% deformed Ni-9.3 at % W alloy rolled at ambient temperature.
Figure 4H:
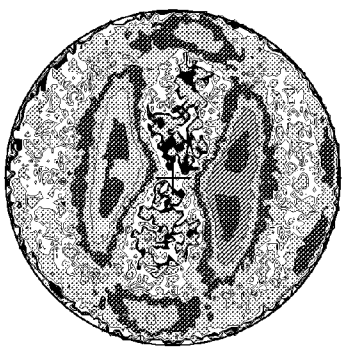
FIG. 4*h* is a (111) pole figure for a 99.9% deformed Ni-9.3 at % W alloy rolled at ambient temperature.
Figure 4I:
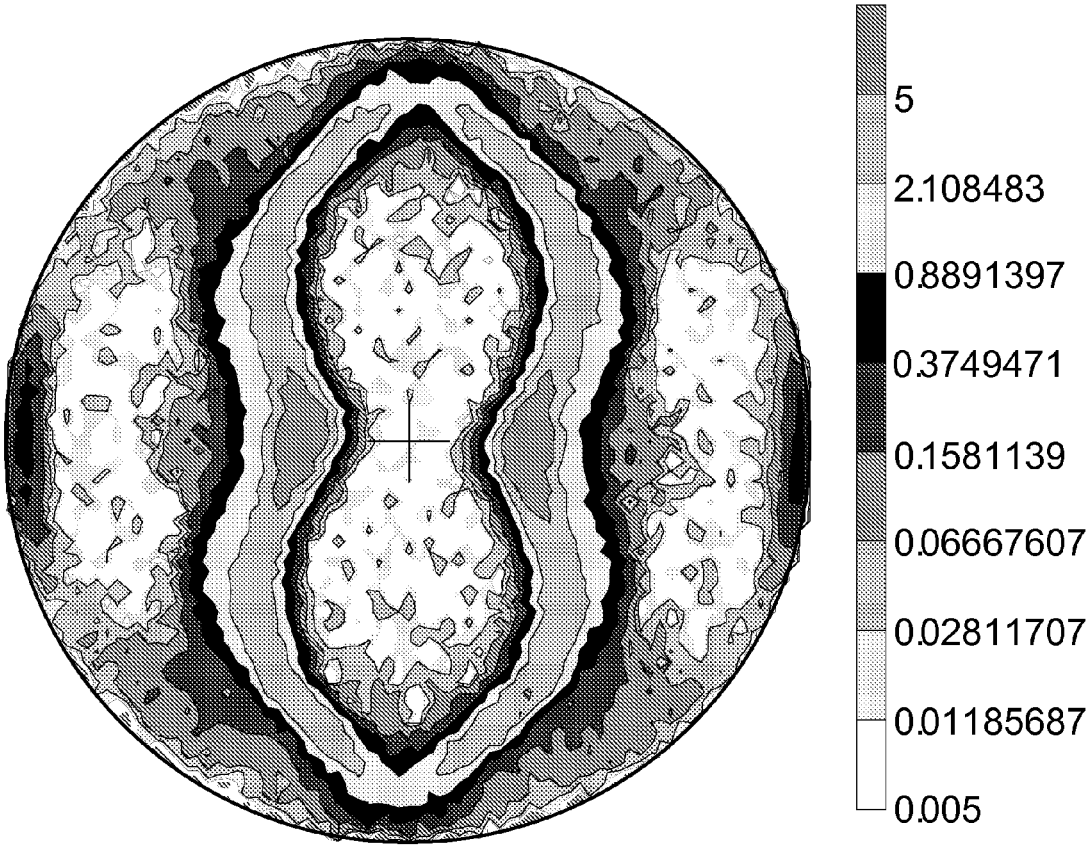
FIG. 4*i* is a (111) pole figure for a 99.9% deformed Ni rolled at ambient temperature showing the desired Cu-type texture for comparison.

To further illustrate the shortcomings of ambient (i.e., room) temperature rolling of Ni-≧5 at % W alloy substrates, FIGS. 4*a*-4*h* shows the evolution of texture in Ni-9.3 at % W. The same is true for all compositions equal to or beyond 5 at % W. Breakdown into the "alloy-type" texture starts right from 80% deformation and continues all the way to 99.9% deformation. FIG. 4*i* is a (111) pole figure for a 99.9% deformed Ni rolled at ambient temperature showing the desired Cu-type texture for comparison.

The present invention utilizes polycrystalline, cube-textured, {100}<100>, FCC-based alloy characterized by a yield strength greater than 200 MPa. A most suitable alloy is Ni—W includes W in an amount in the range of 5 to 10 atomic %, preferably in the range of 7 to 9.7 atomic %, more preferably in the range of 8 to 9.5 atomic %, more preferably in the range of 9 to 9.4 atomic %, most preferably about 9.3 atomic %.

In accordance with the present invention, the alloy substrate is warm-rolled, which is defined for purposes of describing the present invention as rolling at a temperature in the range of 50° C. to a temperature that is below the primary recrystallization temperature of the alloy. (The primary recrystallization temperature of a particular alloy is known to those skilled in the art.) It is most practical to employ the rolling process at the lowest possible temperature while imparting the highest quality biaxial texture to the alloy. Therefore, a preferred temperature range is 50° C. to 500° C., more preferably 60° C. to 300° C., more preferably 70° C. to 200° C., more preferably 90° C. to 150° C., most preferably 100° C. to 130° C., each range including every possible temperature therewithin.

The purpose of rolling at a temperature higher than ambient temperature is to reverse the texture transition that typically occurs with high solute additions to Ni. For a given composition of alloying addition to Ni, wherein the stacking fault energy is significantly reduced and a brass-type deformation texture is formed upon rolling at room-temperature, it was surprisingly discovered that this can be changed to copper-type by performing the deformation at higher temperatures. Upon performing a recrystallization annealing of the material with a copper-type rolling texture, a sharp cube texture is obtained upon annealing under appropriate conditions.

The rolled and annealed substrate is ready for deposition of an epitaxial functional layer such as a superconductor, semiconductor, photovoltaic device, ferroelectric device etc. In particular, the substrate is suitable for deposition of buffer layers and a superconducting layer.

Example I

Figure 5A:
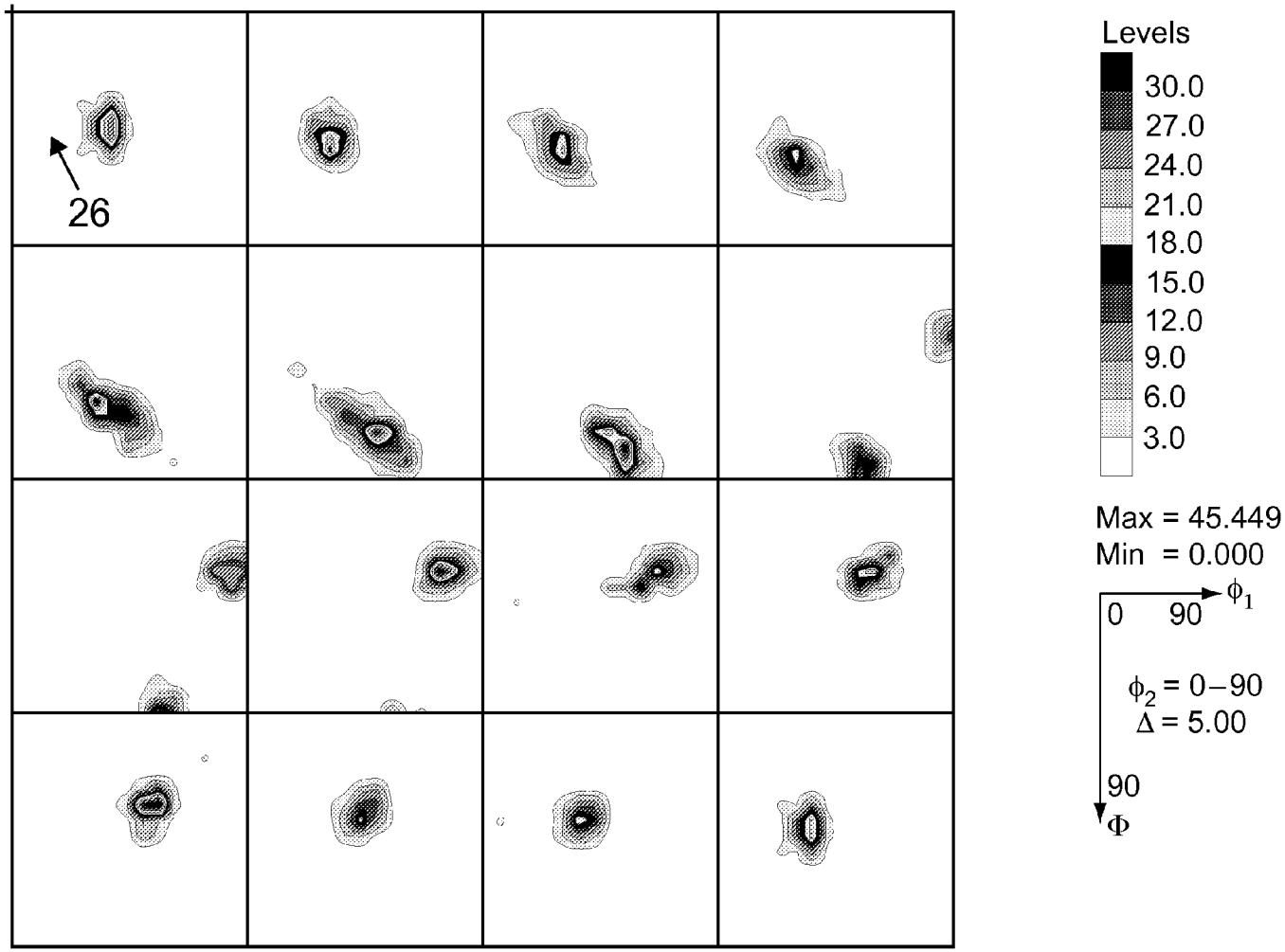
FIG. 5*a* is a series of diagrams showing slices of the ODF' for a 99.9% deformed Ni-9.3 at % W alloy rolled at an elevated temperature in accordance with the present invention. A Cu-type rolling texture has been maintained, as indicated by the absence of an α-fiber, shown by arrow 26.
Figure 5B:
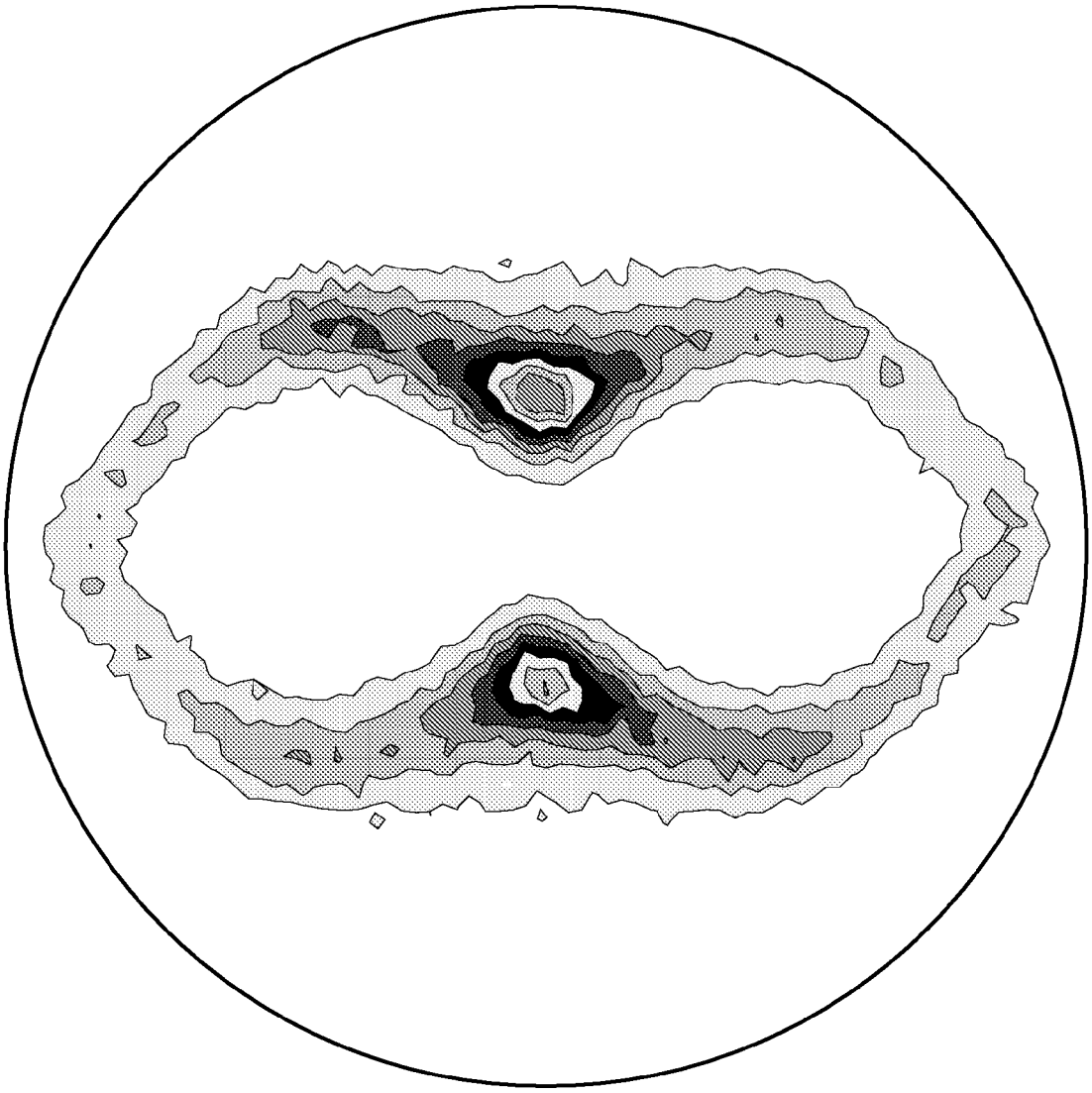
FIG. 5*b* is a (111) pole figure for a 99.9% deformed Ni-9.3 at % W alloy rolled at an elevated temperature in accordance with the present invention.

A bar of Ni-9.3 at % W was successively rolled to total deformations greater than 95% by heating the Ni-9.3 at % W bar in a box furnace at 500° C. followed by rolling. Upon touching the rolls, the temperature of the NiW alloy was rapidly reduced and estimated to be about 200° C. A 1-meter tape exhibiting Cu-type rolling texture was obtained, with no α-fiber present, as shown in the ODF in FIG. 5*a* and the (111) pole figure in FIG. 5*b*.

Example II

Figure 6A:
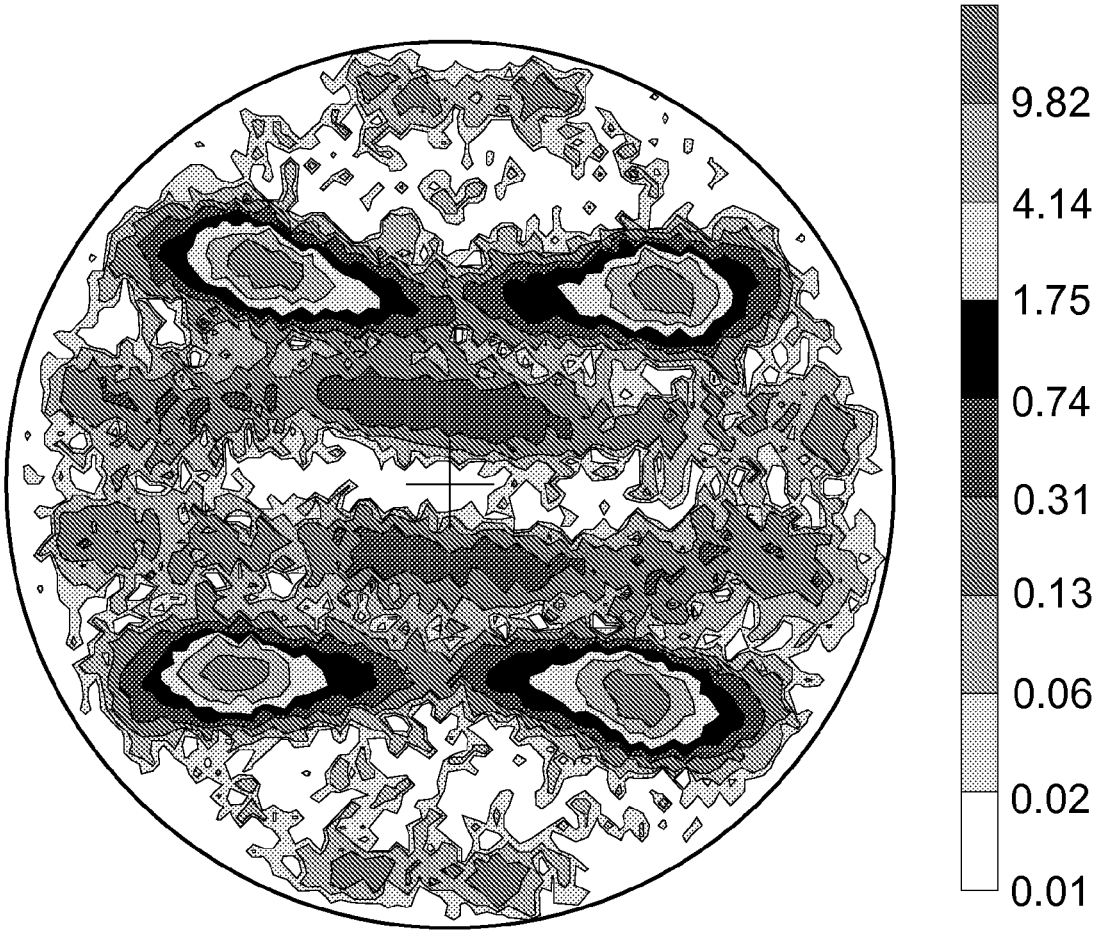
FIG. 6*a* shows a (111) pole figure of a 99.9% deformed Ni-9.3 at % W alloy rolled at an elevated temperature in accordance with the present invention and recrystallized by annealing at 1100° C.
Figure 6B:
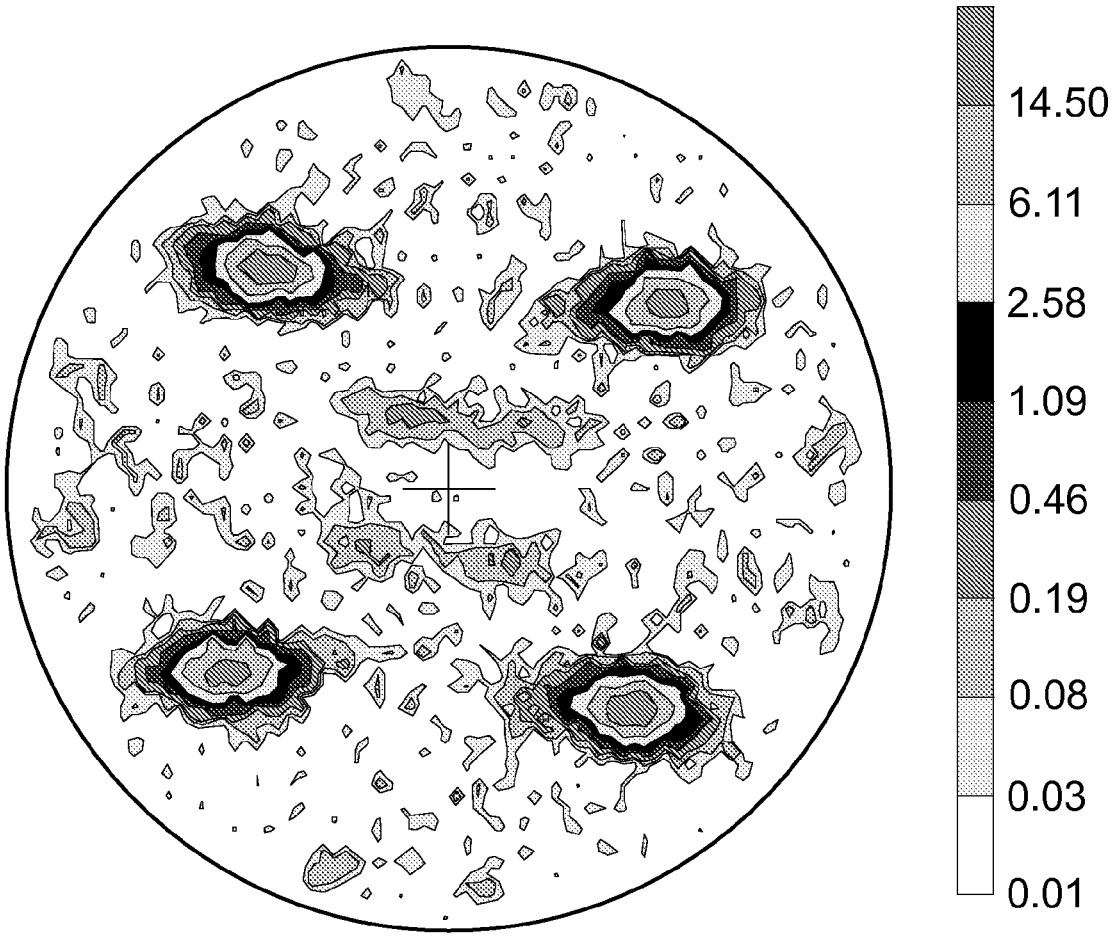
FIG. 6*b* shows a (111) pole figure of a 99.9% deformed Ni-9.3 at % W alloy rolled at an elevated temperature in accordance with the present invention and recrystallized by annealing at 1200° C.
Figure 6C:
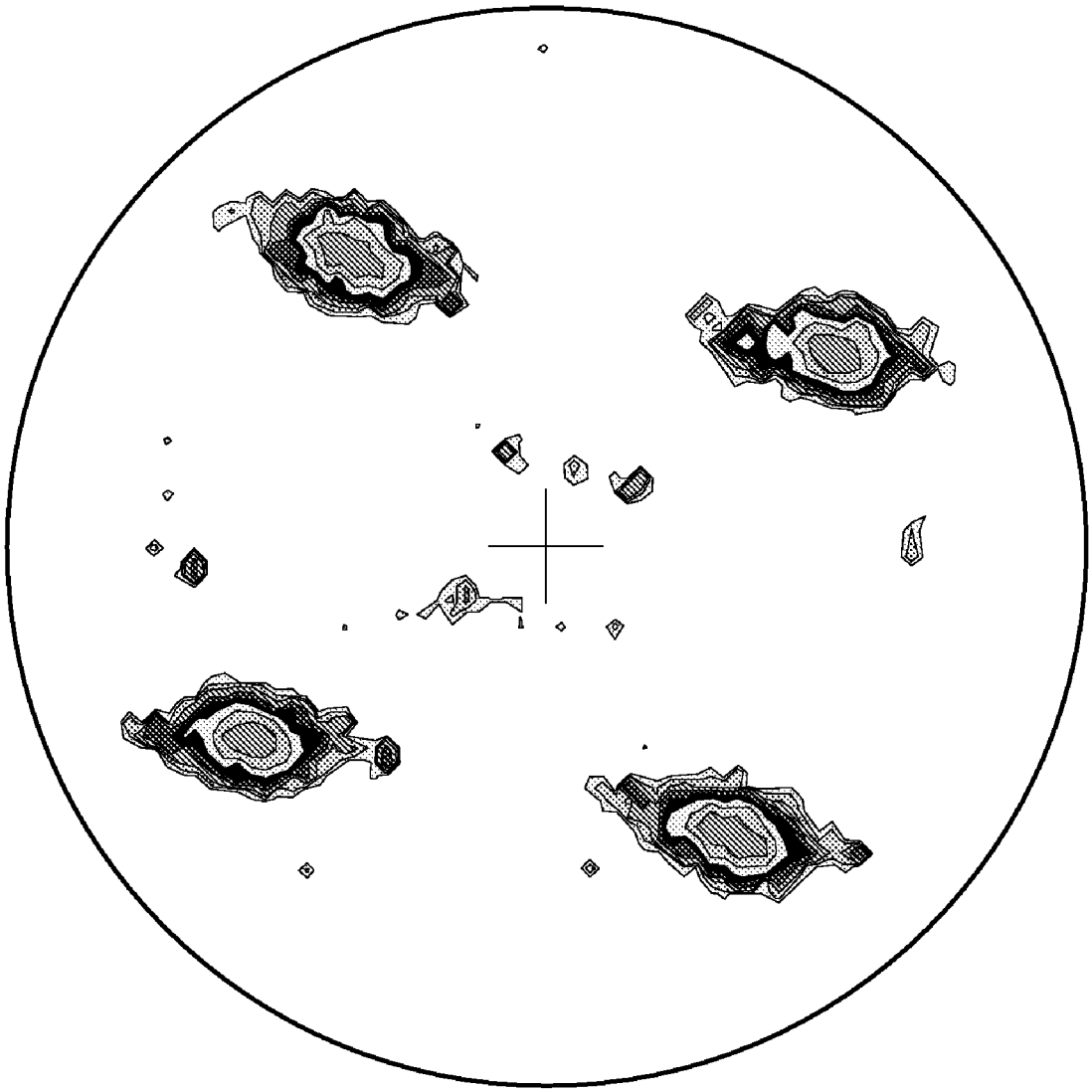
FIG. 6*c* shows a (111) pole figure of a 99.9% deformed Ni-9.3 at % W alloy rolled at an elevated temperature in accordance with the present invention and recrystallized by annealing at 1300° C. A predominantly cube texture is observed with the percentage cube texture being greater than 97%.
Figure 7A:
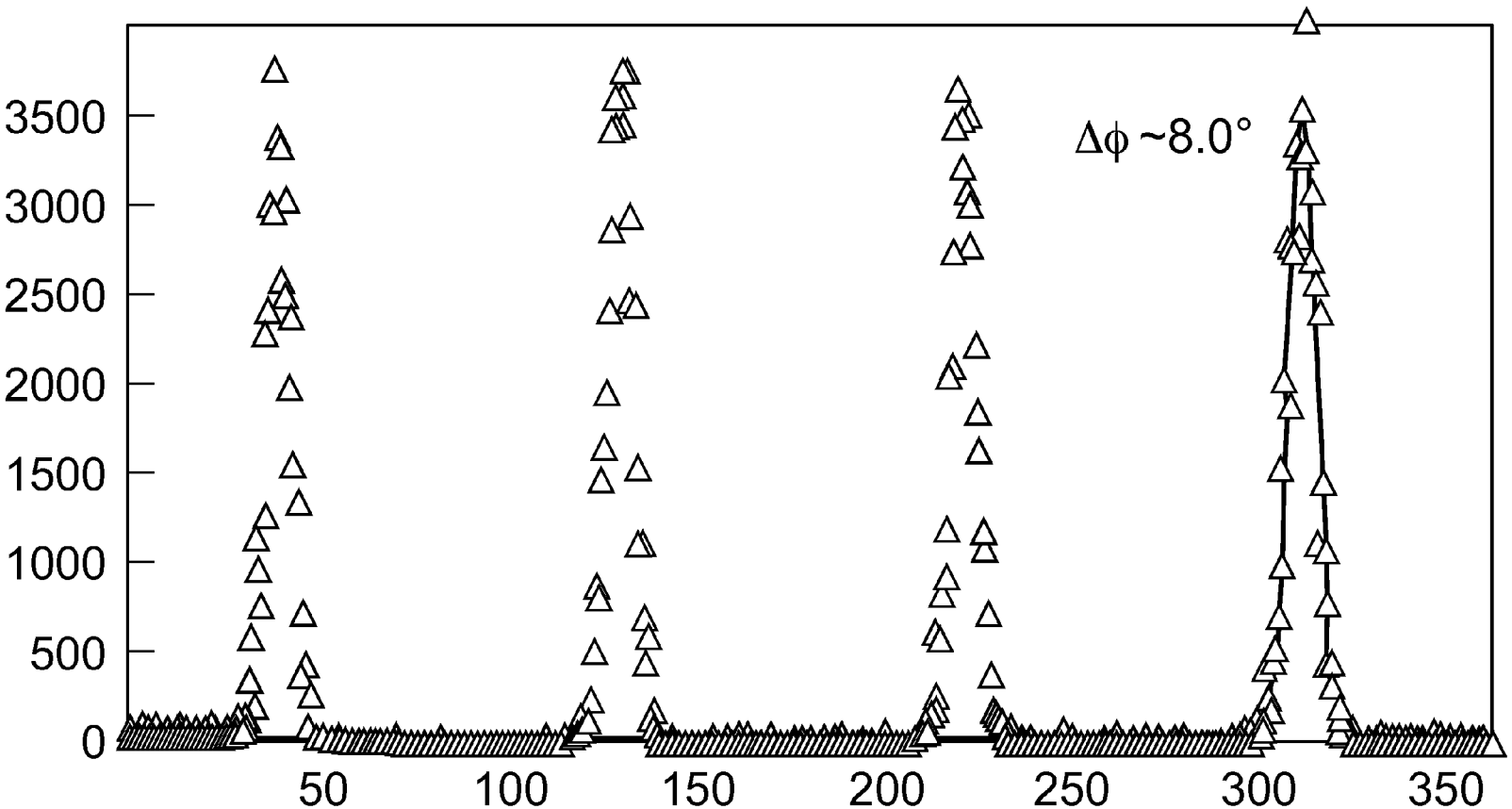
FIG. 7*a* shows a (111) phi-scan or the in-plane texture of a 99.9% deformed Ni-9.3 at % W alloy rolled at an elevated temperature in accordance with the present invention and recrystallize annealed at 1300° C. A FWHM of ~8° is obtained.
Figure 7B:
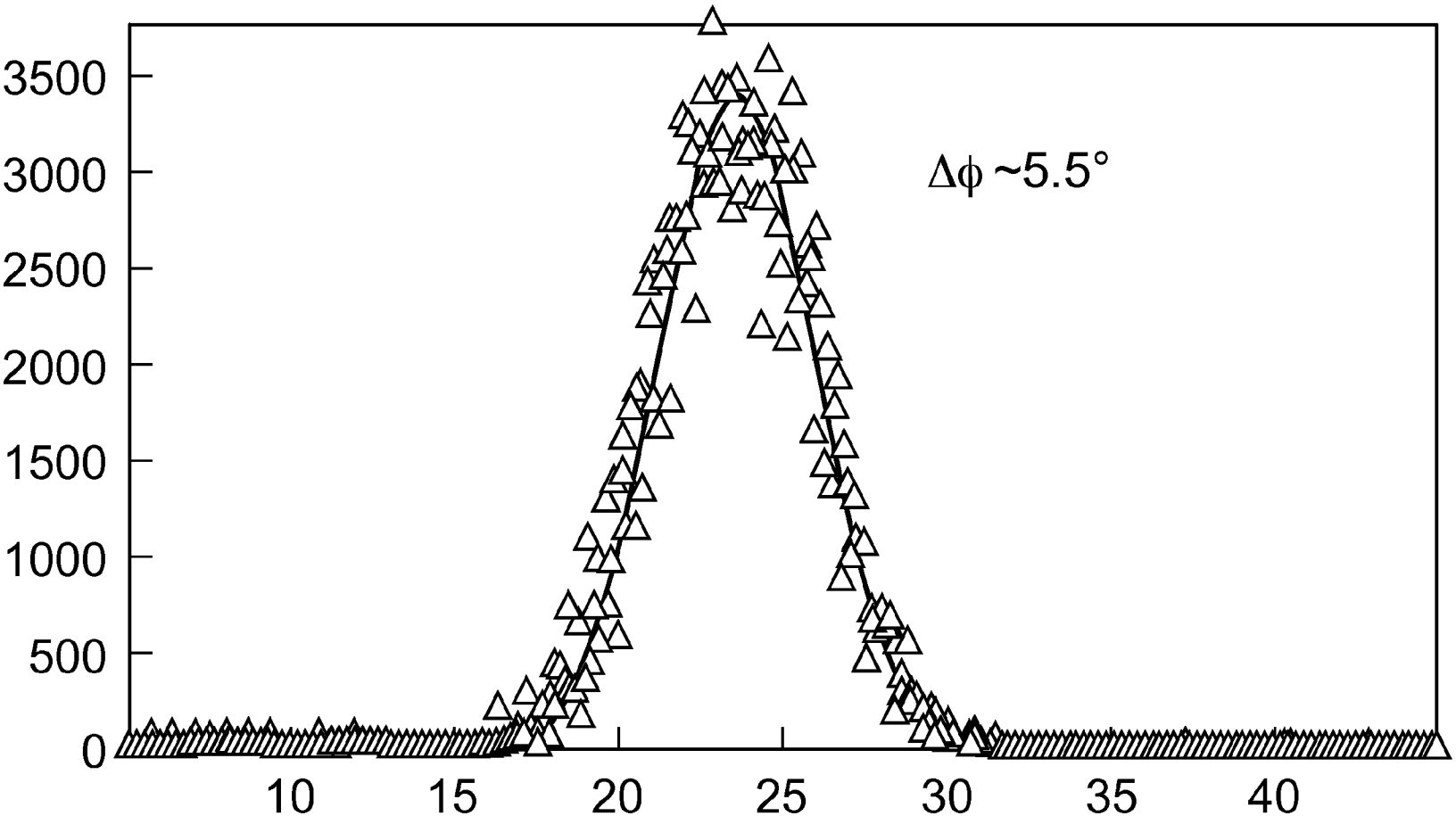
FIG. 7*b* shows a (200) omega-scan or rocking curve of a 99.9% deformed Ni-9.3 at % W alloy rolled at an elevated temperature in accordance with the present invention and recrystallize annealed at 1300° C. A FWHM of ~5.5° is obtained.

Tapes made in accordance with Example I were annealed under conventional conditions, including temperatures of about 1100° C., 1200° C., and 1300° C. Prior to recrystallization annealing, the tapes were chemically etched in a suitable acid solution to remove the surface layers which may contain some embedded oxide particles produced during the hot-rolling process. The chemical etching is done to remove such layers since such particles can inhibit grain growth and recrystallization by effectively pinning the grain boundaries. A biaxial texture was obtained, as shown in FIGS. 6*a*, 6*b*, 6*c*, which show (111) pole figures for NiW. FIG. 6*c* shows that a clean cube texture is obtained. The percentage cube texture in FIG. 6*c* is 97% cube texture. FIG. 7*a* shows a (111) phi-scan or the in-plane texture of the substrate for which the (111) pole figure is shown in FIG. 6*c*. A FWHM of the phi-scan of 8° is obtained. FIG. 7*b* shows the rocking curve or the out-of-plane texture of the substrate for rocking in the rolling direction. A FWHM of the phi-scan of 5.5° is obtained. The yield strength of the cube textured substrate with the stress applied along the [100] axis was found to be ~270 MPa. Furthermore the Crie temperature of the alloy was estimated to be 25K and the substrate was found to have a saturation magnetization of 4.36 Guass-$cm^2$/g.

Example III

Annealed tapes made in accordance with Examples I and II were tested for suitability of epitaxial deposition of standard buffer layers of $Y_2O_3$/YSZ/$CeO_2$. A Ni-9% W coating was epitaxially deposited on a cube textured Ni-3 at % W substrate. Table 1 shows the quality of biaxial texture of the Ni-9 at % W coating at various positions along the length. Δω refers to the FWHM of out-of-plane texture in the substrate and Δϕ refers to the FWHM of the in-plane texture in the substrate.

TABLE 1

| Position (cm) | Δω FWHM | Δϕ FWHM |
|---|---|---|
| 20 | 5.2 | 6.6 |
| 40 | 5.2 | 6.6 |

TABLE 1-continued

| Position (cm) | Δω FWHM | Δϕ FWHM |
|---|---|---|
| 60 | 5.2 | 6.7 |
| 80 | 5.1 | 6.5 |

Example IV

Various conventional buffer layers were then deposited using conventional methods of physical vapor deposition. Table 2 shows that a conventional oxide buffer stack is compatible with a textured Ni-9 at % W surface and that epitaxial layers of the standard buffer stack used with lower W content alloys such Ni-3 at % W or Ni-5 at % W can be used on Ni-9 at % W.

TABLE 2

| Buffer Layer | Δω, ϕ = 0 | Δω, ϕ = 90 | Δϕ Meas. | Δϕ True |
|---|---|---|---|---|
| $Y_2O_3$ | 3.94 | 5.75 | 6.18 | 5.14 |
| YSZ | 4.23 | 5.85 | 6.65 | 5.61 |
| $CeO_2$ | 3.90 | 5.44 | 6.43 | 5.51 |

Example V

YBCO superconductor layers were deposited by conventional MOD methods on buffered substrates made in accordance with Examples I, II, III and IV. An 0.8 μm thick YBCO layer deposited epitaxially on this substrate exhibited a critical current density, $J_c$ of 2.4 Million A/$cm^2$ at 77K, self-field.

The invention can be carried out in various ways using conventional techniques. The Ni—W alloy can be heated and rolling in various ways, for example. The alloy can be preheated as described hereinabove, resistively heated, or the rolls can be heated. Other heating methods can also be used. The use of a reducing gas such as forming gas (4% $H_2$ in Argon) is preferred during rolling to prevent oxidation.

Moreover, prior to recrystallization annealing, substrates are preferably chemically etched in a suitable acid solution to remove the surface layers which may contain some embedded oxide particles produced during the hot-rolling process. The chemical etching is done to remove such layers since such particles can inhibit grain growth and recrystallization by effectively pinning the grain boundaries.

Example VI

Bars of Ni-6 at % W to Ni-9.3 at % W were successively rolled to total deformations greater than 95% using the following procedure. The bars were resistively heated while being rolled to a temperature in the range of 50° C.-500° C. Forming gas was flowed to prevent oxidation. A 1-meter tape exhibiting Cu-type rolling texture was obtained, with no alpha-fiber present, similar to the data shown in the ODF's in FIG. 5*a* and the (111) pole figure in FIG. 5*b*. The strength of the substrates ranged from 200-300 MPa. The saturation magnetization of the substrate was in the range of 4-20 Guass-$cm^3$/g.

Example VII

A bar of Ni-9.3 at % W was successively rolled to total deformations greater than 95% at elevated temperatures. In this case the work rolls of the rolling mill were heated to a temperature in the range of 50° C.-500° C. Forming gas was flowed to prevent oxidation. A 1-meter tape exhibiting Cu-type rolling texture was obtained, with no alpha-fiber present, similar to the data shown in the ODF's in FIG. 5*a* and the (111) pole figure in FIG. 5*b*.

Example VIII

Tapes made in accordance with Example VI and VII were annealed in the temperature range of 1000-1300° C. in flowing forming gas. A biaxial texture similar to that shown in FIG. 6*c* is obtained.

Alloys prepared in accordance with the present invention are characterized by a yield strength of at least 200 MPa, preferably at least 220 MPa, more preferably at least 250 MPa, still more preferably at least 280 MPa, most preferably at least 300 MPa. Moreover, alloys prepared in accordance with the present invention are characterized by a saturation magnetization of less than 20 Guass-cm$^2$/g, preferably less than 15 Guass-cm$^2$/g, more preferably less than 10 Guass-cm$^2$/g, most preferably less than 5 Guass-cm$^2$/g. Moreover, many alloys prepared in accordance with the present invention can be characterized by a Curie temperature less than 250K.

Many alloys prepared in accordance with the present invention can comprise other alloying elements. For example a suitable alloy is a binary Ni—Mo alloy, particularly a Ni—Mo alloy having a Mo concentration in the range of 6.5-10 at % Mo. Moreover, the Ni metal used in forming Ni-based alloys used for carrying out the present invention most preferably is of at least about 99% purity in order to obtain optimum results. Some alloys prepared in accordance with the present invention can comprise, for example, a ternary alloy or a quaternary alloy.

Moreover, many alloys prepared in accordance with the present invention can be characterized by a lattice parameter greater than 3.55 Angstroms. Moreover, many alloys prepared in accordance with the present invention can be further characterized by a stacking fault energy, $\gamma$ greater than 25 mJm$^{-2}$ at a temperature of rolling.

While there has been shown and described what are at present considered the preferred embodiments of the invention, it will be obvious to those skilled in the art that various changes and modifications can be prepared therein without departing from the scope of the inventions defined by the appended claims.

What is claimed is:

1. A warm-rolled and annealed, polycrystalline substrate comprising a homogenous solid solution Ni-based alloy that includes W in an amount in the range of 5 to 10 atomic %, said alloy characterized by a yield strength of at least 200 MPa and a biaxial texture characterized by a FWHM of less than 15° in all directions, wherein said Ni-based alloy is further characterized by a saturation magnetism of less than 20 Gauss-cm$^2$/g.

2. A substrate for supporting an epitaxial functional layer in accordance with claim 1 wherein said Ni-based alloy includes W in an amount in the range of 7 to 9.7 atomic %.

3. A substrate for supporting an epitaxial functional layer in accordance with claim 2 wherein said Ni-based alloy includes W in an amount in the range of 8 to 9.5 atomic %.

4. A substrate for supporting an epitaxial functional layer in accordance with claim 3 wherein said Ni-based alloy includes W in an amount in the range of 9 to 9.4 atomic %.

5. A substrate for supporting an epitaxial functional layer in accordance with claim 4 wherein said Ni-based alloy includes W in an amount of about 9.3 atomic %.

6. A substrate for supporting an epitaxial functional layer in accordance with claim 1 wherein said Ni-based alloy is further characterized by a yield strength of at least 220 MPa.

7. A substrate for supporting an epitaxial functional layer in accordance with claim 6 wherein said Ni-based alloy is further characterized by a yield strength of at least 250 MPa.

8. A substrate for supporting an epitaxial functional layer in accordance with claim 7 wherein said Ni-based alloy is further characterized by a yield strength of at least 280 MPa.

9. A substrate for supporting an epitaxial functional layer in accordance with claim 8 wherein said Ni-based alloy is further characterized by a yield strength of at least 300 MPa.

10. A substrate for supporting an epitaxial functional layer in accordance with claim 1 wherein said Ni-based alloy is further characterized by a saturation magnetism of less than 15 Gauss-cm$^2$/g.

11. A substrate for supporting an epitaxial functional layer in accordance with claim 10 wherein said Ni-based alloy is further characterized by a saturation magnetism of less than 10 Gauss-cm$^2$/g.

12. A substrate for supporting an epitaxial functional layer in accordance with claim 11 wherein said Ni-based alloy is further characterized by a saturation magnetism of less than 5 Gauss-cm$^2$/g.

13. A method of making a biaxially textured Ni—W substrate, according to claim 1, comprising the steps of:

a. providing a body of a Ni-based alloy that includes W in an amount in the range of 5 to 10 atomic %;

b. deforming said body by rolling at a temperature of at least 500° C., and less than the primary recrystallization temperature of the alloy; and c. recrystallizing said deformed body by thermal annealing to form a substrate characterized by a yield strength of at least 200 MPa and a biaxial texture characterized by a FWHM of less than 15° in all directions.

14. A method of making a biaxially textured Ni—W substrate in accordance with claim 13 wherein said Ni-based alloy includes W in an amount in the range of 7 to 9.7 atomic %.

15. A method of making a biaxially textured Ni—W substrate in accordance with claim 14 wherein said Ni-based alloy includes W in an amount in the range of 8 to 9.5 atomic %.

16. A method of making a biaxially textured Ni—W substrate in accordance with claim 15 wherein said Ni-based alloy includes W in an amount in the range of 9 to 9.4 atomic %.

17. A method of making a biaxially textured Ni—W substrate in accordance with claim 16 wherein said Ni-based alloy includes W in an amount of about 9.3 atomic %.

18. A method of making a biaxially textured Ni—W substrate in accordance with claim 13 wherein said deforming step is carried out at a temperature in the range of 60° C. to 300° C.

19. A method of making a biaxially textured Ni—W substrate in accordance with claim 18 wherein said deforming step is carried out at a temperature in the range of 70° C. to 200° C.

20. A method of making a biaxially textured Ni—W substrate in accordance with claim 19 wherein said deforming step is carried out at a temperature in the range of 90° C. to 150° C.

21. A method of making a biaxially textured Ni—W substrate in accordance with claim 20 wherein said deforming step is carried out at a temperature in the range of 100° C. to 130° C.

22. A method of making a biaxially textured Ni—W substrate in accordance with claim 13 wherein said Ni-based alloy is further characterized by a yield strength of at least 220 MPa.

23. A method of making a biaxially textured Ni—W substrate in accordance with claim 22 wherein said Ni-based alloy is further characterized by a yield strength of at least 250 MPa.

24. A method of making a biaxially textured Ni—W substrate in accordance with claim 23 wherein said Ni-based alloy is further characterized by a yield strength of at least 280 MPa.

25. A method of making a biaxially textured Ni—W substrate in accordance with claim 24 wherein said Ni-based alloy is further characterized by a yield strength of at least 300 MPa.

26. A method of making a biaxially textured Ni—W substrate in accordance with claim 13 wherein said Ni-based alloy is further characterized by a magnetism of less than 15 Gauss-$cm^2$/g.

27. A method of making a biaxially textured Ni—W substrate in accordance with claim 13 wherein said Ni-based alloy is further characterized by a magnetism of less than 10 Gauss-$cm^2$/g.

28. A method of making a biaxially textured Ni—W substrate in accordance with claim 13 wherein said Ni-based alloy is further characterized by a magnetism of less than 5 Gauss-$cm^2$/g.

29. A substrate comprising a warm-rolled, annealed, homogenous solid solution polycrystalline, cube-textured, {100}<100>, FCC-based alloy characterized by a yield strength greater than 200 MPa and a biaxial texture characterized by a FWHM of less than 15° in all directions wherein said FCC-based alloy is further characterized by a saturation magnetism of less than 20 Gauss-$cm^2$/g.

30. A substrate in accordance with claim 29, wherein said substrate is further characterized by at least 95% cube texture.

31. A substrate in accordance with claim 29, wherein said alloy further comprises a Ni-based alloy.

32. A substrate in accordance with claim 31 wherein said Ni used in forming the Ni alloy is of 99% purity.

33. A substrate in accordance with claim 31 wherein said Ni-based alloy is further characterized by a Curie temperature less than 250K.

34. A substrate in accordance with claim 31, wherein said Ni-based alloy comprises a binary Ni—W alloy having a W concentration in the range of 5-10 at % W.

35. A substrate in accordance with claim 31, wherein said Ni-based alloy comprises a binary Ni—Mo alloy having a Mo concentration in the range of 6.5-10 at % Mo.

36. A substrate in accordance with claim 31 wherein said Ni alloy comprises an alloy selected from the group consisting of a ternary alloy and a quaternary alloy.

37. A substrate in accordance with claim 31 wherein said Ni-alloy is further characterized by a lattice parameter greater than 3.55 Angstroms.

38. A substrate in accordance with claim 31 wherein said Ni-alloy is further characterized by a stacking fault energy, $\gamma$, greater than 25 $mJm^{-2}$ at a temperature of rolling.

39. A substrate in accordance with claim 29 further comprising an epitaxial functional layer.

40. A substrate in accordance with claim 39 further comprising at least one epitaxial buffer layer between said functional layer and said substrate.

41. A method of making a biaxially textured FCC-based alloy substrate, according to claim 29, comprising the steps of:

a. providing a body of an FCC-based alloy that has a yield strength of greater than 200 MPa;

b. deforming said body by rolling at a temperature of at least 50° C. and less than the primary recrystallization temperature of the alloy to form a copper-type rolling texture; and c. recrystallizing said deformed body by thermal annealing to form a cube texture corresponding to {100}<100> and characterized by a FWHM of the biaxial texture of less than 15° in all directions.

42. A method in accordance with claim 41 wherein said substrate has greater than 95% cube texture.

43. A method in accordance with claim 41 wherein said FCC-alloy is a Ni-based alloy.

44. A method of making a biaxially textured Ni-alloy substrate in accordance with claim 43 wherein said Ni-based alloy is a binary alloy of Ni and W with the W in an amount in the range of 6 to 10 atomic %.

45. A method of making a biaxially textured Ni—W substrate in accordance with claim 44 wherein said deforming step is carried out at a temperature in the range of 50° C. to 500° C.

46. A method of making a biaxially textured Ni-alloy substrate in accordance with claim 43 wherein said Ni-based alloy is a binary alloy of Ni and Mo with the Mo in an amount in the range of 6.5 to 10 atomic %.

47. A method of making a biaxially textured Ni—W substrate in accordance with claim 43 wherein said substrate has a Curie temperature of less than 250K.

48. A method of making a biaxially textured Ni—W substrate in accordance with claim 43 wherein said Ni-based alloy is characterized by a yield strength of at least 250 MPa.

49. A method of making a biaxially textured Ni—W substrate in accordance with claim 43 wherein said Ni-based alloy is characterized by a yield strength of at least 300 MPa.

50. A method in accordance with claim 43, wherein said Ni alloy uses a 99% or higher purity Ni.

51. A method in accordance with claim 43 wherein said Ni alloy is a ternary or a quaternary alloy.

52. A method in accordance with claim 43 wherein said Ni-alloy has a lattice parameter greater than 3.55 Angstroms.

53. A method in accordance with claim 43 wherein said Ni-alloy has a stacking fault energy, $\gamma$, greater than 25 $mJm^{-2}$ at the temperature of rolling.

* * * * *